US008434438B2

(12) United States Patent
Weber et al.

(10) Patent No.: US 8,434,438 B2
(45) Date of Patent: May 7, 2013

(54) CAMSHAFT ADJUSTER

(75) Inventors: Juergen Weber, Erlangen (DE); Markus Koerber, Buttenheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 200 days.

(21) Appl. No.: 13/002,803

(22) PCT Filed: Jun. 5, 2009

(86) PCT No.: PCT/EP2009/056962

§ 371 (c)(1),
(2), (4) Date: Jan. 26, 2011

(87) PCT Pub. No.: WO2010/003745

PCT Pub. Date: Jan. 14, 2010

(65) Prior Publication Data

US 2011/0114048 A1 May 19, 2011

(30) Foreign Application Priority Data

Jul. 7, 2008 (DE) ..... 10 2008 032 031

(51) Int. Cl.
*F01L 1/34* (2006.01)

(52) U.S. Cl.
USPC ..... 123/90.17; 29/888.1

(58) Field of Classification Search ..... 123/90.17, 123/90.15; 29/888.1; 71/568 R
See application file for complete search history.

(56) References Cited

U.S. PATENT DOCUMENTS

| | | | | |
|---|---|---|---|---|
| 4,858,572 | A | 8/1989 | Shirai et al. | |
| 6,802,289 | B2 * | 10/2004 | Miyazaka et al. | 123/90.17 |

FOREIGN PATENT DOCUMENTS

| | | | |
|---|---|---|---|
| CN | 1632292 | A | 6/2005 |
| CN | 101087932 | A | 12/2007 |
| CN | 101087933 | A | 12/2007 |
| CN | 101115910 | A | 1/2008 |
| DE | 198 08 618 | A1 | 9/1999 |
| DE | 10 2004 005 822 | A1 | 8/2005 |
| DE | 10 2005 020 529 | A1 | 11/2006 |
| EP | 0 801 212 | A | 10/1997 |
| EP | 0 924 393 | A | 6/1999 |
| EP | 1 544 419 | A | 6/2005 |
| EP | 1 544 420 | A | 6/2005 |
| WO | 01/44627 | A | 6/2001 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

A camshaft adjuster for an internal combustion engine of a motor vehicle, including a stator which can be driven by a crankshaft of an internal combustion engine and is located radially on the outside, a rotor which is non-rotatably connected to a camshaft and located radially on the inside, working chambers which are disposed between the rotor and stator and can be subjected to a pressure such that the rotational position of the rotor relative to the stator can be varied, and at least one sealing cover which laterally delimits the working chambers and rests against the stator and/or rotor. The sealing cover, stator and/or rotor have a convex, concave or conical contact surface, and the sealing cover can be elastically deformed by the attachment via the contact surface such that it rests against the stator and/or rotor with an increased sealing force as a result of elastic deformation.

7 Claims, 3 Drawing Sheets

CAMSHAFT ADJUSTER

This application is a 371 of PCT/EP2009/056962 filed Jun. 5, 2009, which in turn claims the priority of DE 10 2008 032 031.5 filed Jul. 7, 2008, the priority of both applications is hereby claimed and both applications are incorporated by reference herein.

FIELD OF THE INVENTION

The invention relates to a camshaft adjuster with the features of the preamble of claim 1.

DE 10 2005 020 529 A1 has already disclosed a camshaft adjuster of the type in question, with a sealing cover, referred to there as a side limb, which has an annular disk-shaped basic body which is connected to the stator via a screw connection and bears in a sealing manner against a rotor of the camshaft adjuster. The sealing cover has an annular disk-shaped basic body which merges at the radially inner end thereof into an axially cylindrical extension. It has been shown from experience that, despite maximum manufacturing accuracy, there is the risk, under the effect of elastic deformations in the screw assembly, of the gap between the rotor, the blades and the screwed-on sealing cover enlarging and, as a result, the internal loss due to leakage in the camshaft adjuster being increased.

It is the object of the invention to provide a camshaft adjuster with reduced internal losses due to leakage.

This is achieved by the sealing cover, the stator and/or the rotor having a convex, concave or conical bearing surface, and the sealing cover being elastically deformable by the fastening via the bearing surface. By means of the proposed solution, the minimum gap between the rotor and sealing cover can be specifically adjusted by elastic adaptation of the shape of the sealing cover under the action of the prestressing force caused by the fastening of the sealing cover. By means of the proposed solution, in addition to the retaining force applied by the fastening of the sealing cover, a sealing force is produced by the elastic deformation of the sealing cover such that the sealing force as a whole can be increased. The increased sealing force reduces a gap which may be present between the sealing cover and the stator or the rotor and therefore also the possible internal losses due to leakage. Furthermore, unevennesses in the surface can be compensated for. So that the rotor does not become wedged against the sealing cover by means of the prestressing force, the bending deformation enables a minimum axial gap to be set between the rotor and the sealing cover by means of the bending deformation of the sealing cover. The sealing cover is fastened to the stator by screws and bears against said stator with a static seal being formed. The increased sealing force is then preferably absorbed via the static seal in relation to the stator while the dynamic seal between the sealing cover and rotor, said seal formed by the axial gap, can be adjusted to just such an extent that the rotor can still rotate without obstruction in relation to the sealing cover.

The increase in the sealing force can be dimensioned in a structurally simple manner by the convex, concave or conical bearing surface being arranged on the sealing cover, the rotor or the stator, and the opposite bearing surface being formed on the sealing cover, the rotor or the stator by a flat plane. This enables the degree of elastic deformation and the sealing force arising therewith to be determined in a very simple manner since only one bearing surface causes the deformation. Furthermore, only one bearing surface has to be machined by a corresponding surface-machining operation or other shaping operation whereas the other bearing surface in each case does not have to be changed, thus enabling the costs incurred to be reduced.

A further reduction in the production costs can be achieved by the convex, concave or conical bearing surface being provided on the sealing cover.

The adjustability of the axial gap can be produced in a particularly simple manner by the bearing surface on the sealing cover being of convex or conical design, and the sealing cover being connected in the outer region thereof to the stator. By means of the convex or conical shaping of the bearing surface, the sealing cover is at a distance from the stator in the outer region before being fastened to the stator. The sealing cover is then pulled up to the stator in the outer region thereof by the fastening such that said sealing cover undergoes an elastic deformation and, starting from the fastening, is pressed at the radially inner region thereof against the stator or the rotor.

In this case, the bearing surface on the stator should preferably be formed by a convex or flat plane, i.e. it should be avoided that the bearing surface has a concave shape. So that the bearing surface never has a concave shape due to manufacturing inaccuracies, a slightly convex shape should therefore preferably always be selected such that the bearing surface forms at least a flat plane even if there are deviations in shape. A concave bearing surface would again neutralize or at least weaken the intended effect of the elastic deformation of the sealing cover.

It is furthermore proposed that the sealing cover has on its radial inner side an annular extension which is directed away from the bearing surface. By means of the extension, the sealing cover as a whole is stiffened in relation to the internal stresses generated by the fastening, and therefore said sealing cover has very high dimensional accuracy even under loads.

The invention is explained in more detail below with reference to a preferred exemplary embodiment. In the drawings.

Figure 1:
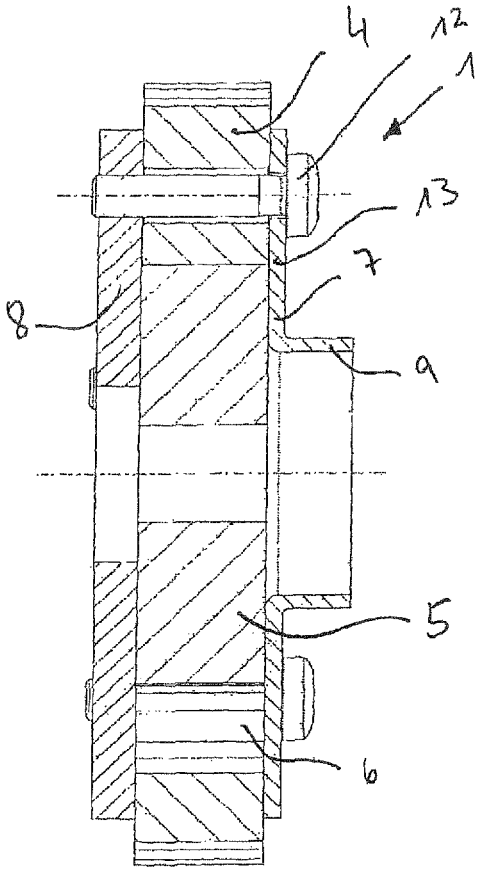
FIG. 1 shows a camshaft adjuster with a sealing cover.

A camshaft adjuster 1, with a stator 4, which is driven by a crankshaft (not illustrated) of an internal combustion engine, and with a rotor 5 which is connected to a camshaft in a rotationally fixed manner can be seen in FIG. 1. A plurality of working chambers 6 delimited laterally by the sealing cover 7 and the sealing washer 8 are arranged between the stator 4 and the rotor 5. The working chambers 6 are formed by radially inwardly protruding projections of the stator 4, which projections are supported on the radially inner diameter of the rotor 5. The working chambers 6 are each divided, for example by means of blades assigned to the rotor 5, into two working chambers 6 which can be pressurized such that the relative rotational position of the rotor 5 in relation to the stator 4, and therefore also of the camshaft in relation to the crankshaft, can be changed. The sealing cover 7 is fixedly connected to the stator 4 by a plurality of screws 12 distributed around the circumference, the screws 12 being screwed into the radially inwardly directed projections. The sealing cover 7 is formed by an annular disk-shaped basic body 13 and an annular extension 9 adjoining the radial inner side. The annular extension 9 is arranged in such a manner that it is directed away from the rotor 5 and the stator 4 and serves to receive a radial shaft sealing ring (not illustrated) which bears against the camshaft.

Figure 2:
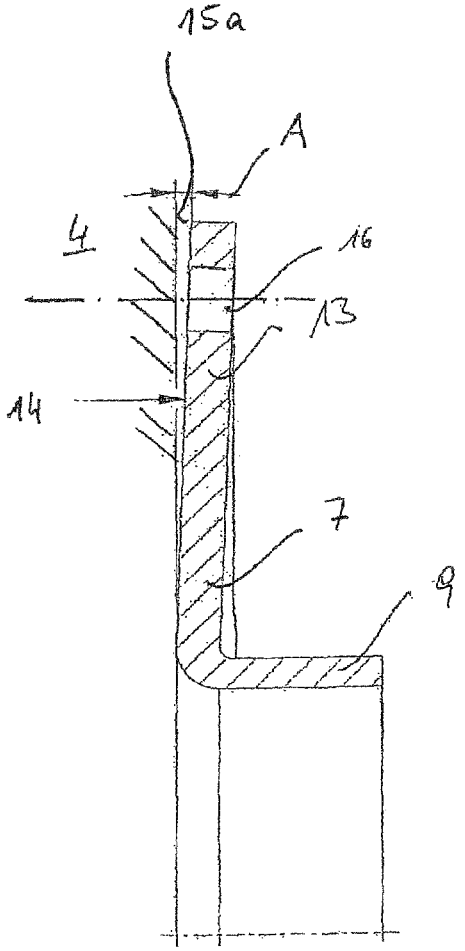
FIG. 2 shows a sealing cover with a convex bearing surface.
Figure 3:
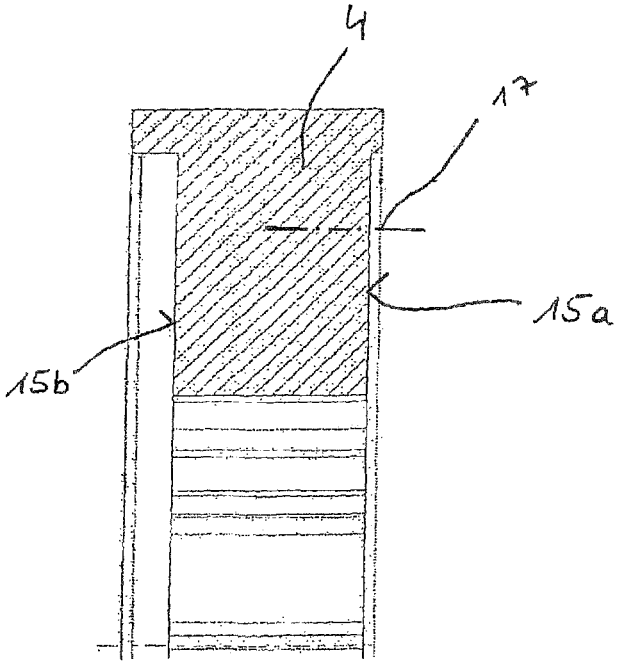
FIG. 3 shows a stator with flat bearing surfaces.

The sealing cover 7 prior to the fastening thereof to the stator 4 can be seen in FIG. 2. The annular disk-shaped basic body 13 has a convex or else conical bearing surface 14 which provides a radially outwardly increasing distance "A" from the opposite flat bearing surface 15*a* of the stator 4. The stator 4 with the flat bearing surfaces 15*a* and 15*b* which are arranged thereon and on which the sealing cover 7 and the sealing washer 8 are then arranged can be seen in FIG. 3. The stator 4 is provided with a screw-in bore 17 in which the sealing cover 7 is fastened by screwing in of the screw 12 guided through the passage bore 16 in the sealing cover 7. During the tightening of the screw 12, the gap "A" is drawn shut under elastic deformation of the annular disk-shaped basic body 13 of the sealing cover 7. In this case, a convex design of the bearing surface 14 has the advantage that the gap "A" is reduced continuously and, as a result, the available sealing surface is enlarged continuously. By means of the elastic deformation of the basic body 13 in the fastened state, which is illustrated in FIG. 1, a sealing force which increases radially inward from the screw 12 is exerted by the bearing surface 14 on the bearing surface 15*a*. As the screw force increases, the gap "A" is drawn shut, and therefore said gap can be adjusted by the prestress. The sealing force which is increased by the elastic deformation then reliably prevents a gap from being produced between the sealing cover 7 and the stator 4 during operation or a gap which may be present from becoming wider. By contrast, the increased sealing force brings about smoothing of the surface profile such that any unevennesses which may be present can be compensated for or a gap which is present is, if anything, reduced further. Furthermore, the gap present between the sealing cover 7 and the rotor 5 is drawn together to a minimum such that, although the rotor 5 does not become wedged, the losses due to leakage are reduced to a minimum. Overall, the risk of an internal leakage between the working chambers 6 separated by the inwardly directed projections of the stator 4 is therefore considerably reduced, this resulting in a considerable improvement in the functional reliability of the camshaft adjuster as a whole. The annular extension 9 has the advantage that the annular disk-shaped basic body 13 is stiffened in particular in the region directed radially inward from the screw 12 such that the sealing cover 7 has a high degree of dimensional accuracy even in relation to high forces acting thereon from the outside or during continuous operation of the camshaft adjuster. Overall, care should be taken in the design of the pre-shaped sealing cover 7 to ensure that the increased sealing forces cannot lead to the rotor 5 becoming wedged in relation to the sealing cover 7. This can be ensured by the increased sealing forces being substantially absorbed by the stator 4 or by, when tightening the screws 12, the axial gap "A" not being entirely drawn shut but rather only to the extent such that the rotor 5 can still rotate in relation to the sealing cover 7.

The invention claimed is:

1. A camshaft adjuster for an internal combustion engine of a motor vehicle, comprising:

a radially outer stator which can be driven by a crankshaft of an internal combustion engine;

a radially inner rotor which is connected to a camshaft in a rotationally fixed manner;

working chambers which are arranged between the rotor and the stator and can be pressurized in such a manner that a relative rotational position of the rotor with respect to the stator can be changed;

at least one sealing cover which laterally delimits the working chambers and bears against the stator and/or the rotor, the at least one sealing cover having a bore receiving a fastener therethrough for fastening the at least one sealing cover to the stator and/or the rotor, wherein at least one of the sealing cover, the stator, and the rotor has a convex, concave or conical bearing surface such that a gap is present between the at least one sealing cover and the stator and/or the rotor at least in the area of the bore prior to tightening the fastener, and the sealing cover can be elastically deformed to close the gap by tightening the fastener, and a sealing force is exerted between the at least one and the stator and/or the rotor by elastic deformation of the sealing cover when the fastener is tightened.

2. The camshaft adjuster as claimed in claim 1, wherein the convex, concave or conical bearing surface is arranged on the sealing cover, the rotor or the stator, and an opposite bearing surface on the sealing cover, the rotor or the stator is formed by a flat plane.

3. The camshaft adjuster as claimed in claim 1, wherein the convex, concave or conical bearing surface is provided on the sealing cover.

4. The camshaft adjuster as claimed in claim 3, wherein the bearing surface is of convex or conical design, and the bore of the sealing cover is disposed in a radially outer region thereof.

5. The camshaft adjuster as claimed in claim 4, wherein the bearing surface is formed on the stator by a convex or flat plane.

6. The camshaft adjuster as claimed in claim 4, wherein the sealing cover has on a radial inner side an annular extension directed away from the bearing surface.

7. The camshaft adjuster as claimed in claim 4, wherein the bearing surface is convex and the sealing force increases in a direction radially inward from the bore.

* * * * *

UNITED STATES PATENT AND TRADEMARK OFFICE

CERTIFICATE OF CORRECTION

PATENT NO. : 8,434,438 B2
APPLICATION NO. : 13/002803
DATED : May 7, 2013
INVENTOR(S) : Weber et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 219 days.

Signed and Sealed this
Eighth Day of September, 2015

Michelle K. Lee

Michelle K. Lee
*Director of the United States Patent and Trademark Office*